US011662754B2

(12) United States Patent
Watanabe

(10) Patent No.: US 11,662,754 B2
(45) Date of Patent: May 30, 2023

(54) REFERENCE VOLTAGE CIRCUIT AND ELECTRONIC APPARATUS WITH PROPORTIONAL AND COMPLEMENTARY VOLTAGE GENERATION AND TEMPERATURE CHARACTERISTIC ADJUSTMENT CIRCUIT

(71) Applicant: Sony Semiconductor Solutions Corporation, Kanagawa (JP)

(72) Inventor: Hiroyuki Watanabe, Kanagawa (JP)

(73) Assignee: Sony Semiconductor Solutions Corporation, Kanagawa (JP)

( * ) Notice: Subject to any disclaimer, the term of this patent is extended or adjusted under 35 U.S.C. 154(b) by 193 days.

(21) Appl. No.: 17/262,096

(22) PCT Filed: Aug. 9, 2019

(86) PCT No.: PCT/JP2019/031619
§ 371 (c)(1),
(2) Date: Jan. 21, 2021

(87) PCT Pub. No.: WO2020/039978
PCT Pub. Date: Feb. 27, 2020

(65) Prior Publication Data

US 2021/0294366 A1 Sep. 23, 2021

(30) Foreign Application Priority Data

Aug. 24, 2018 (JP) ..... JP2018-157158

(51) Int. Cl.
*G05F 1/46* (2006.01)
*G05F 1/567* (2006.01)
(Continued)

(52) U.S. Cl.
CPC ..... *G05F 1/468* (2013.01); *G05F 1/567* (2013.01); *G05F 3/245* (2013.01); *G05F 3/267* (2013.01)

(58) Field of Classification Search
CPC ..... G05F 1/468; G05F 1/567; G05F 3/245; G05F 3/267
See application file for complete search history.

(56) References Cited

U.S. PATENT DOCUMENTS

2003/0197552 A1* 10/2003 Watanabe ..... G05F 3/245 327/541
2007/0152740 A1 7/2007 Georgescu et al.
(Continued)

FOREIGN PATENT DOCUMENTS

CN 102081423 A 6/2011
CN 103026311 A 4/2013
(Continued)

OTHER PUBLICATIONS

Hirose et al., "A CMOS Bandgap and Sub-Bandgap Voltage Reference Circuits for Nanowatt Power LSIs", Feb. 2011, IEEE Asian Solid-state Circuits Conference, pp. 77-88 (Year: 2011).*
(Continued)

*Primary Examiner* — Kyle J Moody
*Assistant Examiner* — Lakaisha Jackson
(74) *Attorney, Agent, or Firm* — Michael Best & Friedrich LLP

(57) ABSTRACT

A reference voltage circuit (1) includes a PTAT voltage generation circuit (20) that generates a voltage with a positive temperature coefficient, a CTAT voltage generation circuit (10) that generates a voltage with a negative temperature coefficient, and a temperature characteristic adjustment circuit (30) that generates a voltage for adjusting temperature characteristics. The reference voltage circuit
(Continued)

outputs a reference voltage (VOUT) formed by calculation based on the output of the PTAT voltage generation circuit, output of the CTAT voltage generation circuit, and output of the temperature characteristic adjustment circuit.

20 Claims, 10 Drawing Sheets

(51) Int. Cl.
*G05F 3/26* (2006.01)
*G05F 3/24* (2006.01)

(56) References Cited

U.S. PATENT DOCUMENTS

| | | | | |
|---|---|---|---|---|
| 2015/0177771 | A1 | 6/2015 | Marinca | |
| 2019/0025868 | A1* | 1/2019 | Segarra | G05F 3/30 |
| 2020/0073430 | A1* | 3/2020 | Panja | G05F 3/30 |
| 2020/0218302 | A1* | 7/2020 | Brule | G01R 19/32 |
| 2020/0233445 | A1* | 7/2020 | Mouret | G05F 1/462 |

FOREIGN PATENT DOCUMENTS

| | | | |
|---|---|---|---|
| CN | 107608441 | A | 1/2018 |
| JP | 07-193442 | A | 7/1995 |
| JP | 2003-283258 | A | 10/2003 |
| JP | 2009-522661 | A | 6/2009 |
| JP | 2017-126280 | A | 7/2017 |

OTHER PUBLICATIONS

International Search Report (PCT/ISA/210), International Application No. PCT/JP2019/031619, dated Aug. 26, 2019.

Notification of Transmittal of the International Search Report and the Written Opinion of the International Searching Authority, or the Declaration (PCT/ISA/220), International Application No. PCT/JP2019/031619, dated Sep. 10, 2019.

Tetsuya Hirose et al., "A CMOS Bandgap and Sub-Bandgap Voltage Reference Circuits for Nanowatt Power LSIs," IEEE Asian Solid-state Circuits Conference, pp. 77-80, Nov. 2010.

* cited by examiner

REFERENCE VOLTAGE CIRCUIT AND ELECTRONIC APPARATUS WITH PROPORTIONAL AND COMPLEMENTARY VOLTAGE GENERATION AND TEMPERATURE CHARACTERISTIC ADJUSTMENT CIRCUIT

TECHNICAL FIELD

The present disclosure relates to reference voltage circuits and electronic apparatuses. To be more specific, the present invention relates to a reference voltage circuit suitable for use in, for example, an ultra-low power consumption circuit system, and an electronic apparatus provided with such a reference voltage circuit.

BACKGROUND ART

For element circuits that constitute apparatuses driven by coin batteries for a long time, and element circuits that constitute ultra-low power consumption apparatuses powered by energy harvesting that uses energy that is dissipated such as heat and vibration, low power consumption of a nanowatt class is required.

There is a reference voltage circuit (VREF circuit) as one of the element circuits included in all devices. FIG. 9 illustrates the principle of a general reference voltage circuit. The reference voltage circuit 9 generates a reference voltage having no temperature characteristic, by multiplying a PTAT (Proportional To Absolute Temperature) voltage whose temperature coefficient is positive and a CTAT (Complementary to Absolute Temperature) voltage whose temperature coefficient is negative by predetermined coefficients as necessary, and adding these to each other so as to cancel each temperature characteristic. In general, at least one of the coefficient $\beta_{PTAT}$ or the coefficient $\beta_{CTAT}$ is set to "1," and at least one of the PTAT voltage ($V_{PTAT}$) or the CTAT voltage ($V_{CTAT}$) is often added as it is.

There are several types of reference voltage circuits. In recent years, a reference voltage circuit that achieves low power consumption by operating MOSFETs in a subthreshold region has been proposed (see, for example, NPL 1). FIG. 10 is a schematic circuit diagram of a reference voltage circuit 9A having such a configuration. The reference voltage circuit 9A includes a CTAT voltage generation circuit 10 having a circuit in which a base and a collector of a PNP transistor Q are grounded and a PTAT voltage generation circuit 20 having a configuration in which structures each for extracting the gate voltage difference between two paired MOSFETs are connected in multiple stages. The reference sign $M_P$ represents a transistor that serves as a current source, and the reference sign $M_N$ represents a transistor that acts as a load resistor. This reference voltage circuit 9A can utilize the subthreshold characteristic of the MOSFET for the temperature coefficient compensation of the output voltage, and can achieve both area saving and low current consumption as compared with other types.

The voltage $V_{BE}$ is the base-emitter voltage of the bipolar transistor Q, and corresponds to the CTAT voltage having a negative temperature coefficient as described later. The PTAT voltage having a positive temperature coefficient is generated by connecting the gate voltage differences of the MOSFETs in multiple stages, and the output voltage $V_{REF1}$ is expressed by the following equation (1). Here, the reference sign $\eta$ is a coefficient called the slope factor of the MOSFET and represents the device characteristics, the reference sign $k_B$ is the Boltzmann constant, the reference sign q is the elementary charge, and the reference signs $W_{2j}$ and $L_{2j}$ represent the gate width and the gate length of a transistor $M_{2j}$. Similarly, the reference signs $W_{2j-1}$ and $L_{2j-1}$ also represent the gate width and the gate length. An example illustrated in FIG. 10 indicates $1 \leq j \leq 5$. The first term of the equation (1) corresponds to the CTAT voltage having a negative temperature coefficient, and the second term corresponds to the PTAT voltage having a positive temperature coefficient.

$$V_{REF_1} = V_{BE} + \sum_{j=1}^{5} \eta \frac{k_B}{q} T ln\left(\frac{W_{2j-1}/L_{2j-1}}{W_{2j}/L_{2j}}\right) \tag{1}$$

CITATION LIST

Non Patent Literature

[NPL 1]
Tetsuya Hirose et al., "A CMOS Bandgap and Sub-Bandgap Voltage Reference Circuits for Nanowatt Power LSIs," IEEE Asian Solid-state Circuits Conference, pp. 77-80, November 2010.

SUMMARY

Technical Problems

When attention is paid to the second term of the above equation (1), it is understood that the gate voltage difference of the MOSFET depends on the slope factor $\eta$. The slope factor $\eta$ is a value that characterizes the relationship between the gate voltage and the drain current in the subthreshold region of the MOSFET and is expressed by the formula $\eta=(C_{ox}+C_{dep})/C_{ox}$ when the gate oxide film capacitance is represented by the reference sign $C_{ox}$ and the depletion layer capacitance is represented by the reference sign $C_{dep}$. Therefore, basically, the slope factor $\eta$ is a value that depends on the semiconductor manufacturing process.

If there is a difference between the simulation model and the actual device, there will be a difference between the design temperature characteristics determined by a simulation and the temperature characteristics of the circuit constructed using the actual device. Measures such as adjusting the characteristics by repeating trial manufacture and evaluation can be taken, but for example, it is necessary to adjust the characteristics each time in the case of manufacturing by using other manufacturing facilities, which makes process portability difficult. Therefore, it is conceivable to add a function capable of adjusting the temperature characteristics to the circuit itself.

In order to adjust the temperature characteristics, for example, a method of adjusting the coefficient $\beta_{PTAT}$ and the coefficient $\beta_{CTAT}$ in FIG. 9 can be considered. However, as described above, a difference from the simulation model is likely to occur in the second term corresponding to the PTAT voltage having a positive temperature characteristic in the equation (1). Therefore, it is basically preferable to adjust the MOSFET circuit that generates the PTAT voltage. However, the W/L ratios of the paired MOSFETs that generate the PTAT voltage act as an argument of the logarithmic function. Accordingly, if the adjustment range required for the PTAT voltage is covered, the adjustment range of the W/L ratio becomes too wide, which is not realistic. Further, even if the number of stages of the paired MOSFETs that generate the PTAT voltage is adjusted, the adjustment is discrete, which cannot make fine adjustment.

Therefore, an object of the present disclosure is to provide a reference voltage circuit capable of satisfactorily adjusting the temperature characteristics, and an electronic apparatus provided with such a reference voltage circuit.

Solution to Problems

A reference voltage circuit of the present disclosure for achieving the above object includes a PTAT voltage generation circuit that generates a voltage with a positive temperature coefficient, a CTAT voltage generation circuit that generates a voltage with a negative temperature coefficient, and a temperature characteristic adjustment circuit that generates a voltage to adjust a temperature characteristic, in which the reference voltage circuit outputs a reference voltage formed by calculation from the output of the PTAT voltage generation circuit, the output of the CTAT voltage generation circuit, and the output of the temperature characteristic adjustment circuit.

An electronic apparatus of the present disclosure for achieving the above object is provided with a reference voltage circuit including a PTAT voltage generation circuit that generates a voltage with a positive temperature coefficient, a CTAT voltage generation circuit that generates a voltage with a negative temperature coefficient, and a temperature characteristic adjustment circuit that generates a voltage to adjust a temperature characteristic, and the reference voltage circuit outputs a reference voltage formed by calculation from the output of the PTAT voltage generation circuit, the output of the CTAT voltage generation circuit, and the output of the temperature characteristic adjustment circuit.

DESCRIPTION OF EMBODIMENTS

Figure 1:
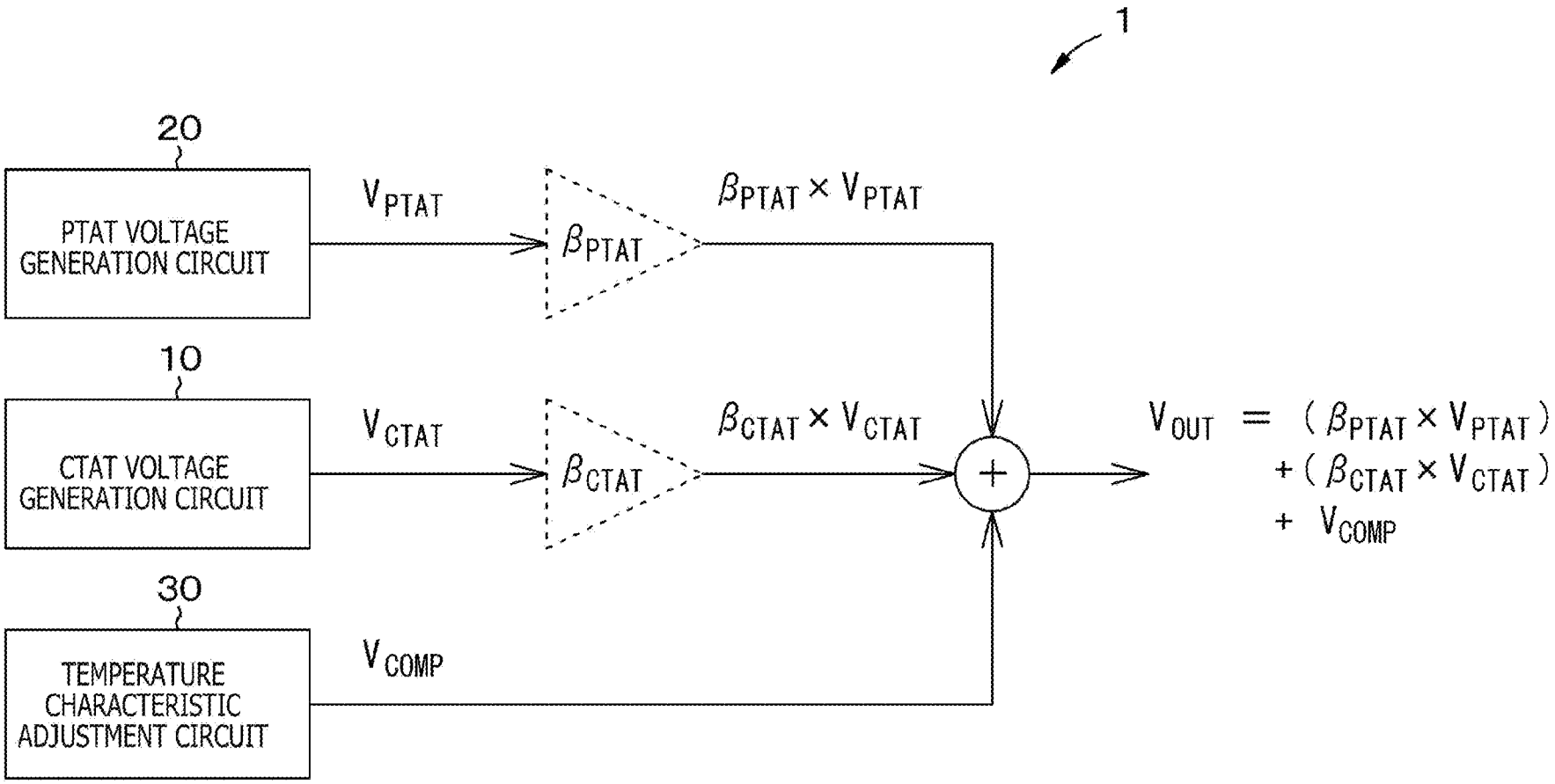
FIG. 1 is a schematic principle diagram of a reference voltage circuit according to a first embodiment.

The present disclosure will be described below on the basis of embodiments with reference to the drawings. The present disclosure is not limited to the embodiments, and various numerical values and materials in the embodiments are examples. In the following description, the same reference signs will be used for the same elements or elements having the same function, and duplicate description will be omitted. Incidentally, the description will be given in the following order.

1. Description of reference voltage circuit, and electronic apparatus, in general related to present disclosure
2. First Embodiment
3. Others

Description of Reference Voltage Circuit, and Electronic Apparatus, in General Related to Present Disclosure In the reference voltage circuit according to the present disclosure, or the reference voltage circuit used in the electronic apparatus according to the present disclosure (hereinafter, these may be simply referred to as "reference voltage circuit of the present disclosure"), the mode can be applied in which the temperature characteristic adjustment circuit is configured so that the voltage difference between the input side and the output side becomes the gate voltage difference of a pair of MOSFETs, and the current density ratio of the drain currents in one MOSFET arranged on the input side and the other MOSFET arranged on the output side is adjustable.

In this case, a configuration can be applied in which a plurality of MOSFETs that can be selected as one MOSFET and/or a plurality of MOSFETs that can be selected as the other MOSFET are arranged. Note that, from the viewpoint of increasing the degree of freedom of adjustment, it is preferable for each of the one MOSFET and the other MOSFET to have a configuration in which a plurality of selectable MOSFETs is arranged.

In this case, the plurality of MOSFETs can be arranged in parallel. Then, a plurality of MOSFETs having the same W/L ratio may also be arranged. In this case, for example, it is sufficient if the number of MOSFETs to be selected is adjusted. The MOSFETs can be selected, for example, by trimming a semiconductor element on which a reference voltage circuit is formed.

Alternatively, a plurality of MOSFETs having different W/L ratios can also be arranged. In this case, it is sufficient if a MOSFET having a desired W/L ratio is selected alone, or a plurality of MOSFETs may be selected so that the W/L ratio of the MOSFET group becomes a desired value.

Alternatively, a plurality of MOSFETs may also be arranged in series. Also in this case, a plurality of MOSFETs having the same W/L ratio may be arranged, or a plurality of MOSFETs having different W/L ratios may also be arranged.

In the reference voltage circuit of the present disclosure including the various preferable configurations described above, the MOSFET of the temperature characteristic adjustment circuit can be configured to operate in the subthreshold region.

The mode can be applied in which the reference voltage circuit of the present disclosure having the various preferable configurations described above includes a current mirror circuit for passing a drain current through each of the paired MOSFETs, and the current mirror circuit is configured so that the mirror ratio is adjustable. In this case, the current mirror circuit may be configured such that a plurality of MOSFETs that can be selected as MOSFETs that pass the mirror current is arranged.

In the reference voltage circuit of the present disclosure including the various preferable configurations described above, the mode can be applied in which the PTAT voltage generation circuit is configured by connecting structures each for extracting the gate voltage difference between two paired MOSFETs in multiple stages. In this case, the MOSFETs of the PTAT voltage generation circuit can be configured to operate in the subthreshold region.

In the reference voltage circuit of the present disclosure including the various preferred configurations described above, the mode can be applied in which the CTAT voltage generation circuit is configured to output the base-emitter voltage of a bipolar transistor.

The reference voltage circuit of the present disclosure is suitable for use in portable electronic apparatuses and the like. As a suitable IC using the reference voltage circuit of the present disclosure, 1. reset IC, 2. power-saving real-time clock IC, and 3. power supply IC can be exemplified.

The satisfaction of the various conditions illustrated in the present specification includes not only cases of being strictly satisfied but also cases of being substantially satisfied. The presence of various design or manufacturing variations is acceptable.

First Embodiment

The first embodiment relates to a reference voltage circuit according to the present disclosure.

FIG. 1 is a schematic principle diagram of the reference voltage circuit according to the first embodiment.

The reference voltage circuit 1 according to the first embodiment includes a PTAT voltage generation circuit 20 that generates a voltage with a positive temperature coefficient, a CTAT voltage generation circuit 10 that generates a voltage with a negative temperature coefficient, a temperature characteristic adjustment circuit 30 that generates a voltage for adjusting a temperature characteristic.

Figure 9:
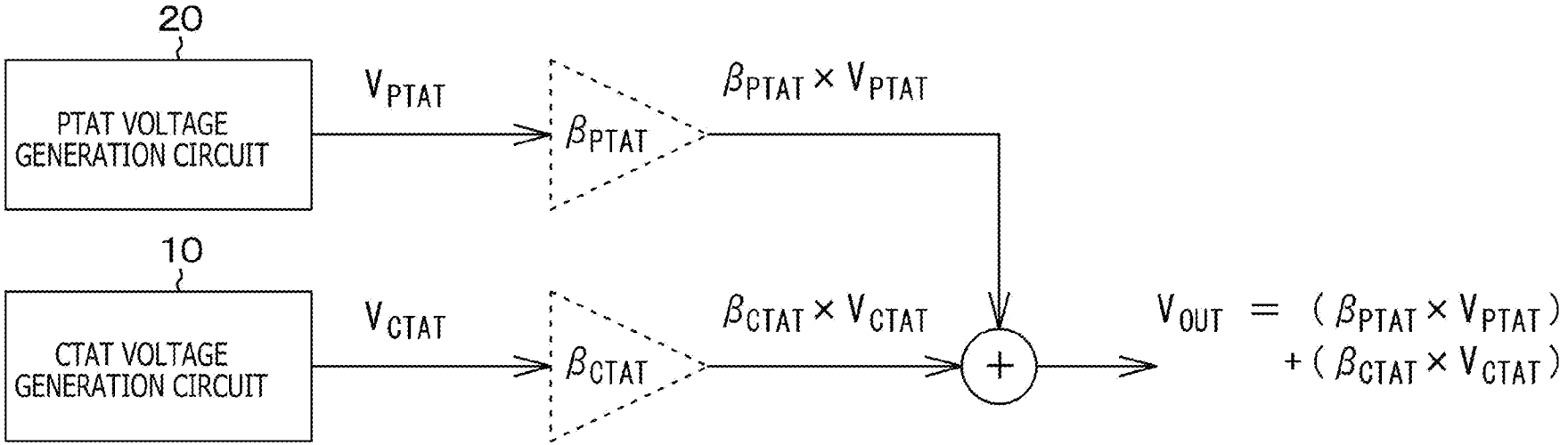
FIG. 9 is a schematic principle diagram of the reference voltage circuit.

Then, the reference voltage formed by calculation from the output of the PTAT voltage generation circuit 20, the output of the CTAT voltage generation circuit 10, and the output of the temperature characteristic adjustment circuit 30 is output. To be more specific, a reference voltage obtained by adding the voltage generated by the PTAT voltage generation circuit 20, the voltage generated by the CTAT voltage generation circuit 10, and the voltage generated by the temperature characteristic adjustment circuit 30 is output. The reference voltage circuit 1 basically has a configuration in which a voltage generated for temperature characteristic adjustment is added to the output voltage of the reference voltage circuit 1 illustrated in FIG. 9. Note that the voltage generated by the PTAT voltage generation circuit 20 and the voltage generated by the CTAT voltage generation circuit 10 may be added after being multiplied by predetermined coefficients, if necessary.

Figure 2:
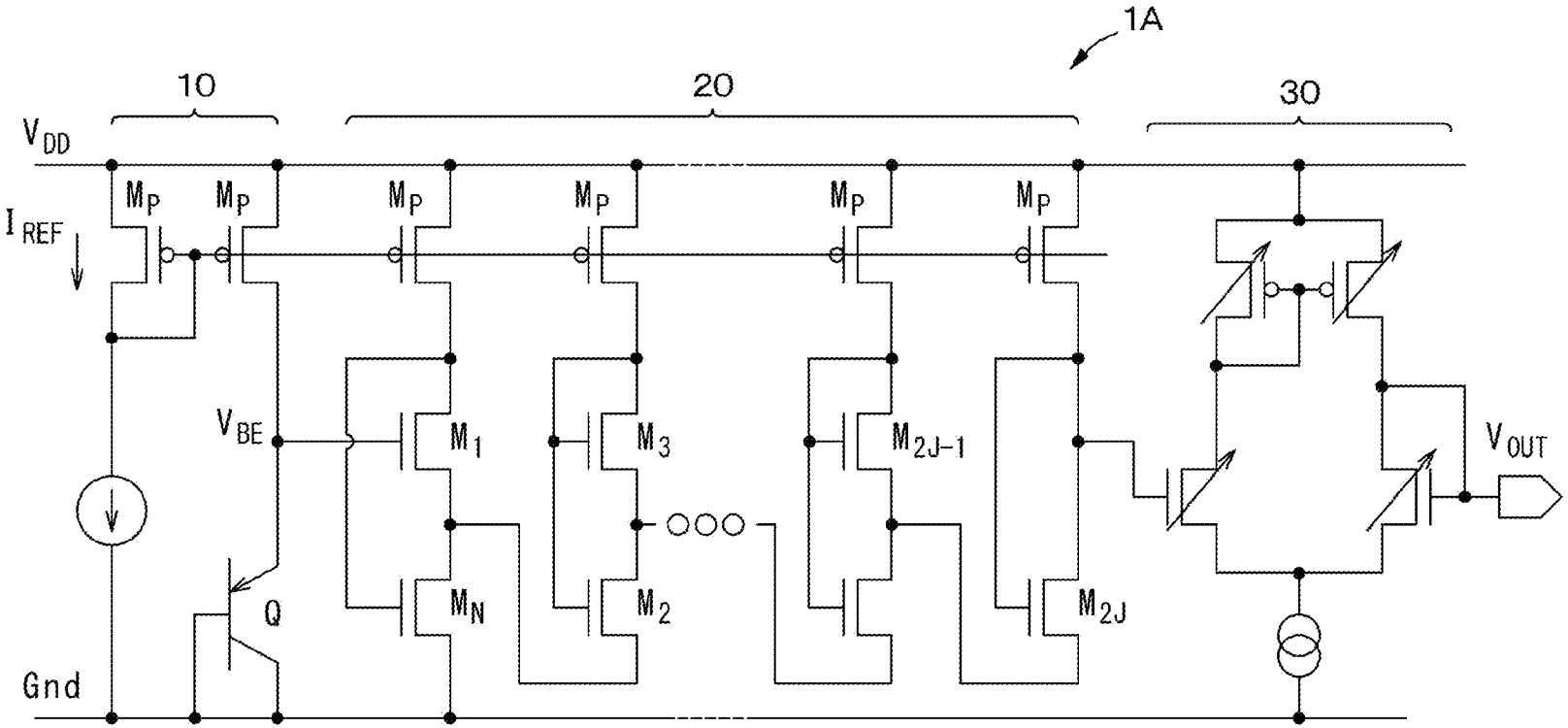
FIG. 2 is a circuit diagram of the reference voltage circuit according to the first embodiment.

FIG. 2 is a circuit diagram of a reference voltage circuit according to the first embodiment.

A specific configuration example of the reference voltage circuit 1 will be described. The CTAT voltage generation circuit 10 includes a circuit in which the base and the collector of the PNP transistor Q are grounded. The transistor Q is configured so that a mirror current flows from the transistor $M_P$, and the base-emitter voltage $V_{BE}$ is a CTAT voltage ($V_{CTAT}$) having a negative temperature coefficient.

Figure 10:
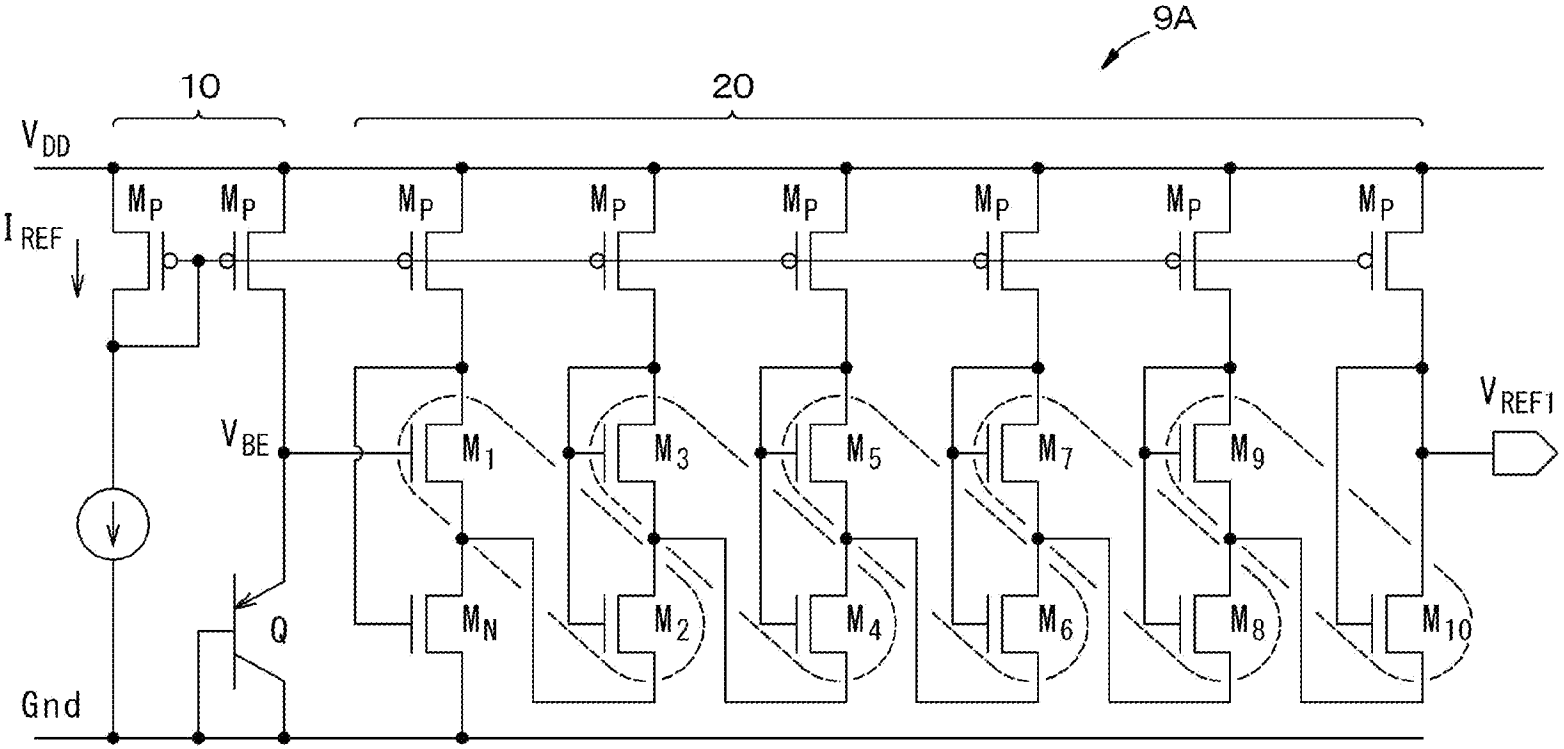
FIG. 10 is a circuit diagram of the reference voltage circuit having a configuration causing MOSFETs to operate in a subthreshold region.

The PTAT voltage generation circuit 20 has a configuration similar to the PTAT voltage generation circuit 20 in the reference voltage circuit 9 illustrated in FIG. 10, and is configured by connecting structures each for extracting the gate voltage difference between two paired MOSFETs in multiple stages. The MOSFETs of the PTAT voltage generation circuit 20 operate in the subthreshold region. The PTAT voltage ($V_{PTAT}$) generated by the PTAT voltage generation circuit 20 is represented by the second term of the above-mentioned equation (1).

Subsequently, the temperature characteristic adjustment circuit 30 will be described.

Figure 3:
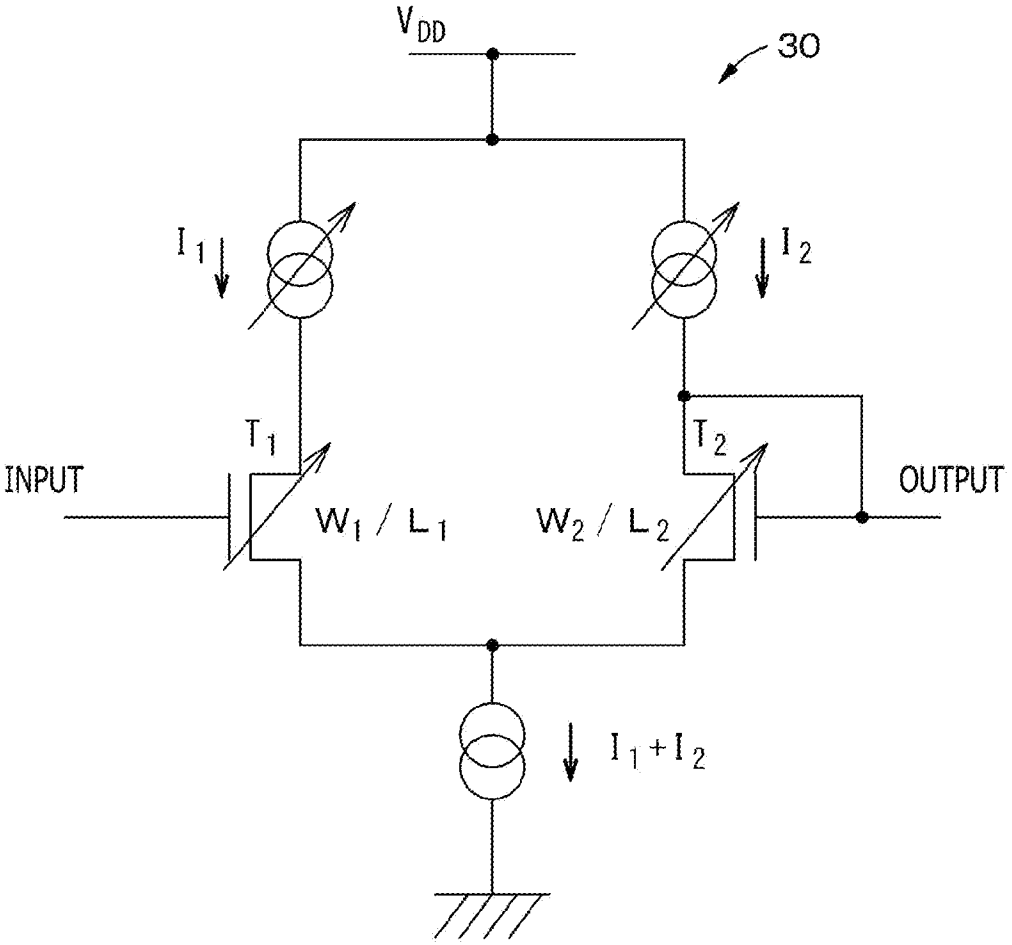
FIG. 3 is a schematic principle diagram of a temperature characteristic adjustment circuit.

FIG. 3 is a schematic principle diagram of the temperature characteristic adjustment circuit.

The temperature characteristic adjustment circuit 30 is configured such that the voltage difference between the input side and the output side becomes the gate voltage difference between a pair of MOSFETs. The MOSFET of the temperature characteristic adjustment circuit is configured to operate in the subthreshold region. Then, the current density ratio of the drain currents in one MOSFET arranged on the input side and the other MOSFET arranged on the output side is adjustable.

The W/L ratio of the input side MOSFET (represented by the reference sign $T_1$) of the two MOSFETs is represented by $W_1/L_1$, and the flowing drain current is represented by the reference sign $I_1$. Further, the W/L ratio of the MOSFET on the output side (represented by the reference sign $T_2$) is represented by $W_2/L_2$, and the flowing drain current is represented by the reference sign $I_2$.

The source sides of two MOSFETs ($T_1$, $T_2$) are connected to each other, and the sum of the source currents of the two MOSFETs ($T_1$, $T_2$) is $I_1+I_2$. At this time, the gate voltage difference $\Delta V_{GS}$ between the two MOSFETs ($T_1$, $T_2$) is represented by the following equation (2).

$$\Delta V_{GS} = \eta \frac{k_B}{q} T tn\left(\frac{I_2}{I_1}\frac{W_1/L_1}{W_2/L_2}\right) \tag{2}$$

Here, in the case where the current densities of the two MOSFETs ($T_1$, $T_2$) are equal, in other words, in the case where the following equation (3) holds, the gate voltage difference $\Delta V_{GS}$ is zero volt.

$$\frac{I_1}{W_1/L_1} = \frac{I_2}{W_2/L_2} \tag{3}$$

Near the condition of the above-mentioned equation (3), the argument of the logarithmic function indicated in the above-mentioned equation (2) is approximately 1. Accordingly, the rate of change of the gate voltage difference with respect to the change of the current density ratio is expressed by the following equation (4).

$$\left.\frac{d\Delta V_{GS}}{d\left(\frac{I_2 W_1/L_1}{I_1 W_2/L_2}\right)}\right|_{\left(\frac{I_2 W_1/L_1}{I_1 W_2/L_2}\right)=1} = \left.\frac{\eta \frac{k_B}{q} T}{\left(\frac{I_2 W_1/L_1}{I_1 W_2/L_2}\right)}\right|_{\left(\frac{I_2 W_1/L_1)}{I_1 W_2/L_2}\right)=1} \approx \eta \frac{k_B}{q} T \tag{4}$$

Here, for example, assuming that the slope factor $\eta=1.5$ and the temperature T=300 K, the right side of the equation (4) is expressed as the following equation (5).

$$\eta\frac{k_B}{q}T \approx 38 \text{ mV} \tag{5}$$

In this way, the temperature characteristic adjustment circuit 30 can generate a voltage ($V_{COMP}$, illustrated in FIG. 1) that changes with sufficient sensitivity to temperature. Further, the degree can be adjusted by adjusting the W/L ratios of the two MOSFETs ($T_1$, $T_2$) and the ratio of the flowing drain currents.

Figure 4:
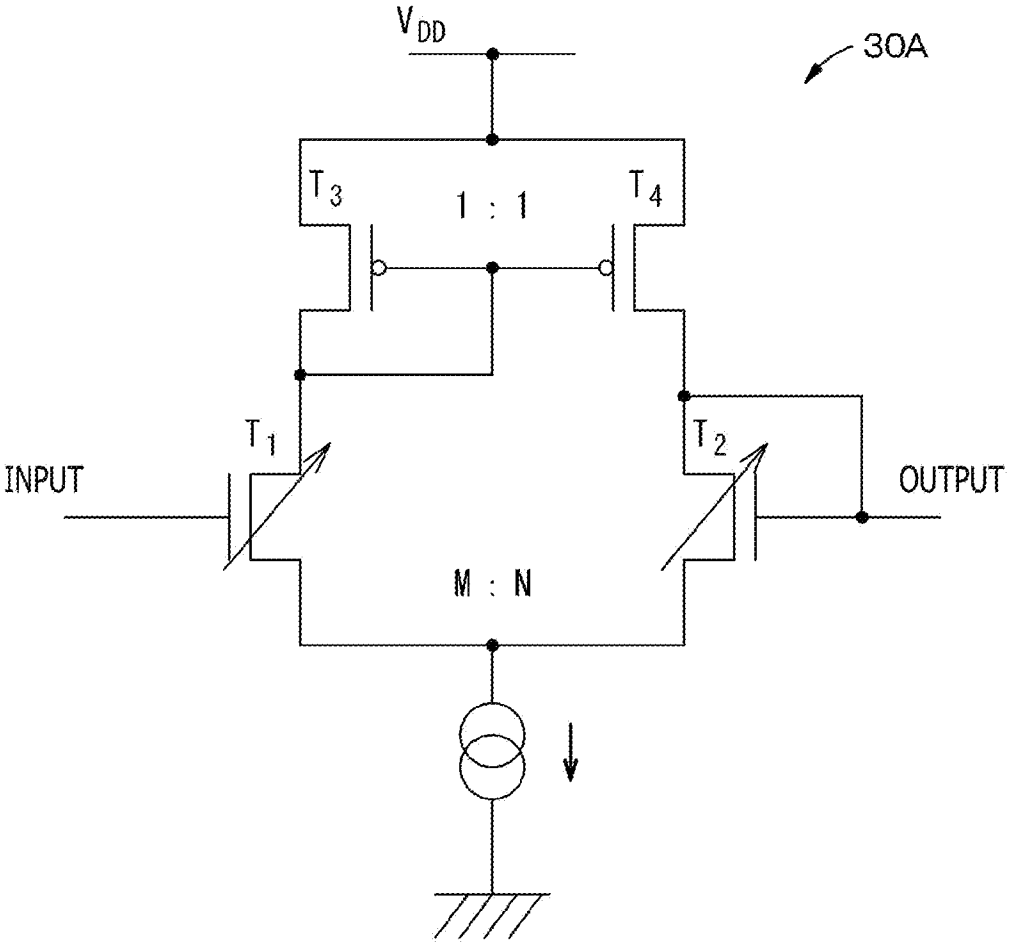
FIG. 4 is a schematic principle diagram of a first example of the temperature characteristic adjustment circuit.

FIG. 4 is a schematic principle diagram of the first example of the temperature characteristic adjustment circuit.

A temperature characteristic adjustment circuit 30A is configured to adjust the W/L ratios (M:N) of the MOSFETs ($T_1$, $T_2$) by using the drain currents of the two paired MOSFETs ($T_1$, $T_2$) as the same currents. The temperature characteristic adjustment circuit 30A includes a current mirror circuit for passing a drain current through each of the paired MOSFETs. A transistor $T_3$ and a transistor $T_4$ constituting the current mirror circuit have the same W/L ratio.

Figure 5:
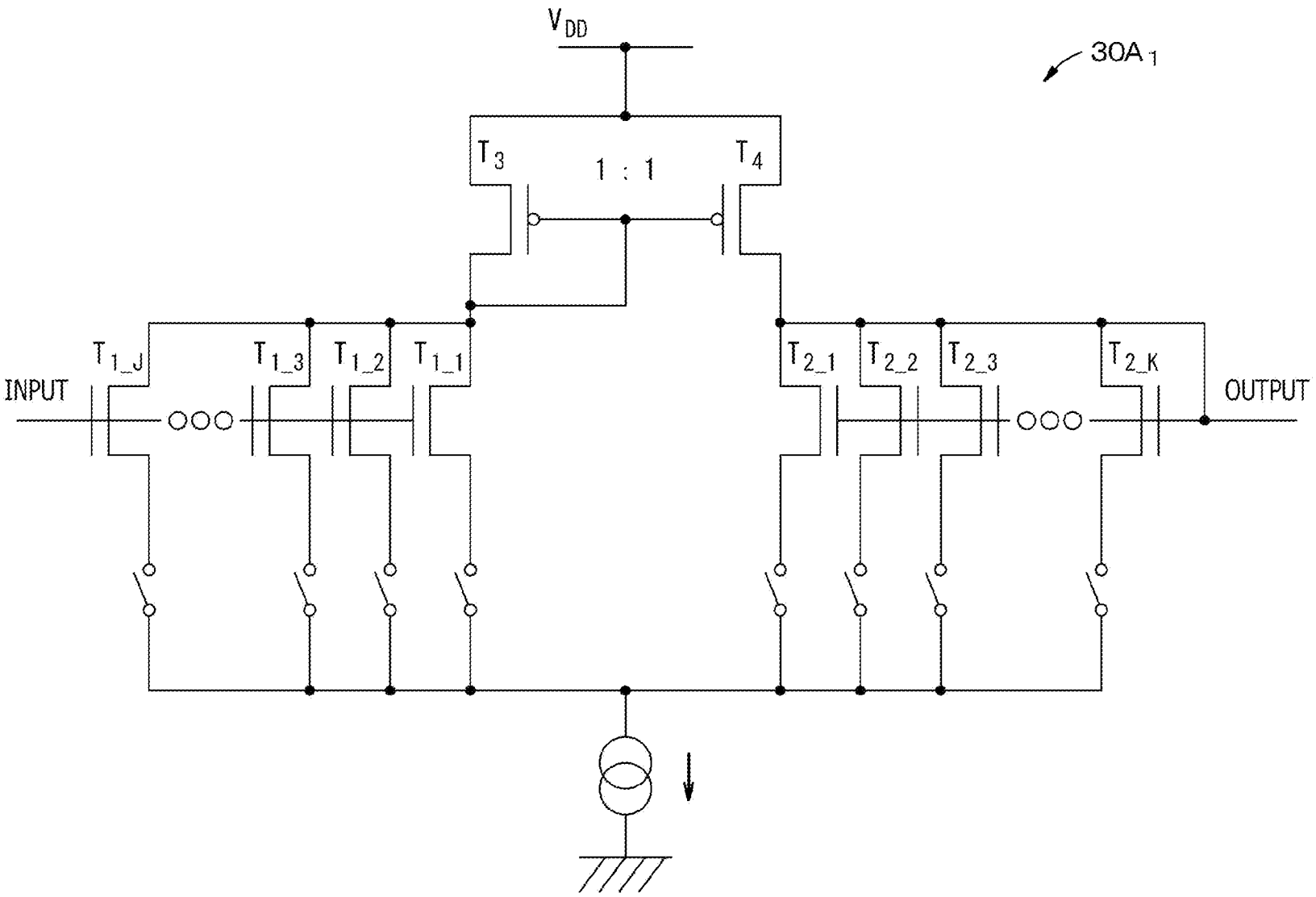
FIG. 5 is a first configuration example of the first example of the temperature characteristic adjustment circuit.

Hereinafter, various configuration examples will be described in detail with reference to the drawings. FIG. 5 is a first configuration example of the first example of the temperature characteristic adjustment circuit.

In a temperature characteristic adjustment circuit 30$A_1$, a plurality of MOSFETs that can be selected as one MOSFET and a plurality of MOSFETs that can be selected as the other MOSFET are arranged. To be more specific, the plurality of MOSFETs is arranged in parallel. Transistors $T_{1_1}$ to $T_{1_J}$ are provided to be selectable as one MOSFET on the input side. Further, transistors $T_{2_1}$ to $T_{2_K}$ are provided to be selectable as the other MOSFET on the output side.

In this configuration, MOSFETs having the same W/L ratio can be arranged as the transistors $T_{1_1}$ to $T_{1_J}$ and the transistors $T_{2_1}$ to $T_{2_K}$. In this case, for example, it is sufficient if the number of MOSFETs to be selected is adjusted. The MOSFETs can be selected, for example, by trimming the semiconductor element on which the reference voltage circuit 1 is formed.

Alternatively, in this configuration, MOSFETs having different W/L ratios may also be arranged as the transistors $T_{1_1}$ to $T_{1_J}$ or the transistors $T_{2_1}$ to $T_{2_K}$. In this case, it is sufficient if a MOSFET having a desired W/L ratio is selected alone, or a plurality of MOSFETs is selected so that the W/L ratio as the MOSFET group becomes a desired value.

It should be noted that in the temperature characteristic adjustment circuit 30$A_1$, it has been assumed that a plurality of MOSFETs that can be selected as one MOSFET and a plurality of MOSFETs that can be selected as the other MOSFET are arranged, but a configuration in which a plurality of MOSFETs is arranged for only one of these can also be used. In this case, although the degree of freedom of adjustment is reduced, the number of elements can be reduced, so that the occupancy area of the circuit can be reduced.

Figure 6:
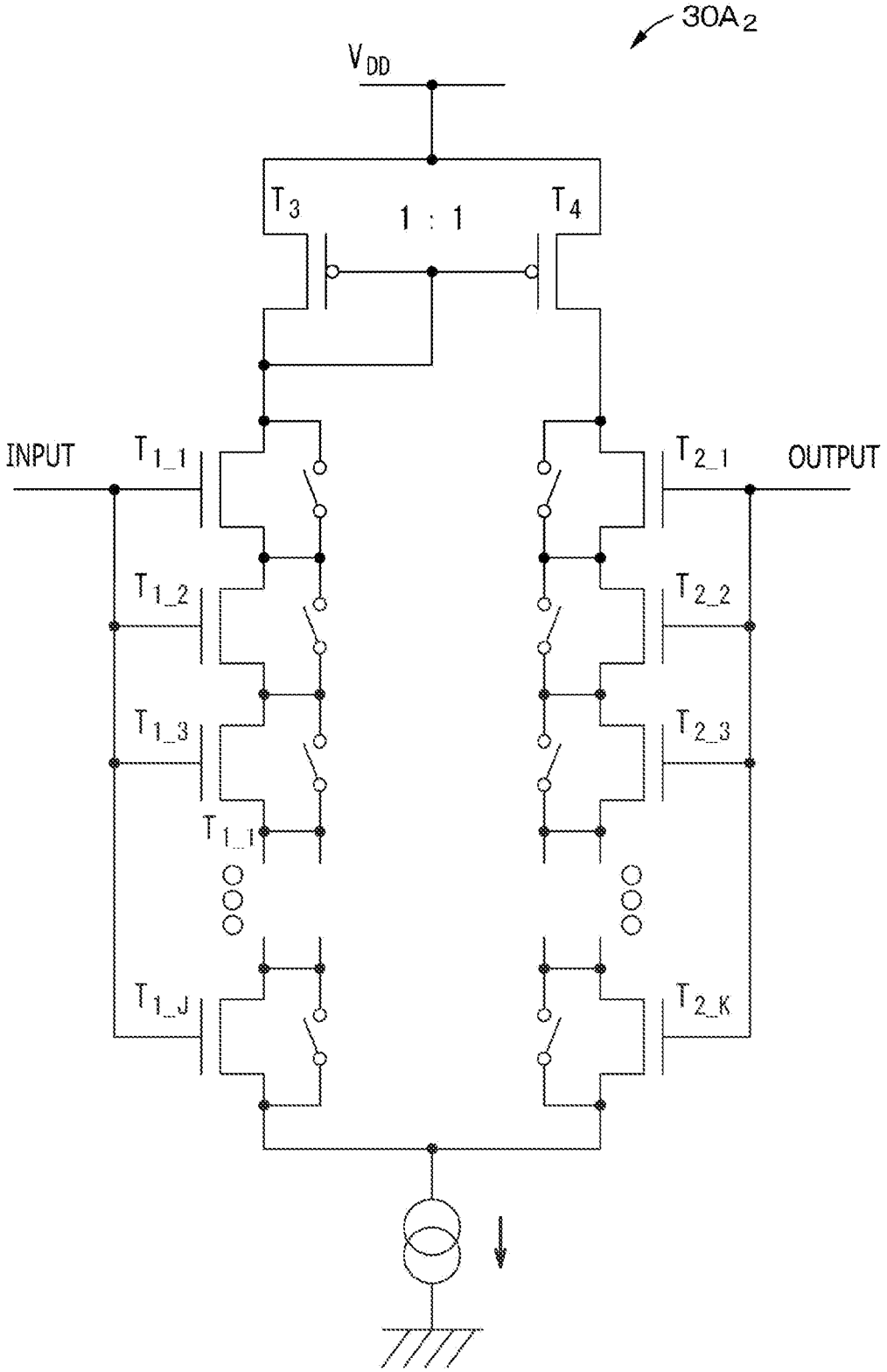
FIG. 6 is a second configuration example of the first example of the temperature characteristic adjustment circuit.

FIG. 6 is a second configuration example of the first example of the temperature characteristic adjustment circuit.

Also in a temperature characteristic adjustment circuit 30$A_2$, a plurality of MOSFETs that can be selected as one MOSFET and a plurality of MOSFETs that can be selected as the other MOSFET are arranged. Note that the plurality of MOSFETs is arranged in series. The transistors $T_{1_1}$ to $T_{1_J}$ are provided to be selectable as one MOSFET on the input side. Further, the transistors $T_{2_1}$ to $T_{2_K}$ are provided to be selectable as the other MOSFET on the output side.

In this configuration, adjustment can be made depending on whether the source/drain regions of the transistors $T_{1_2}$ to $T_{1_J}$ or the transistors $T_{2_2}$ to $T_{2_K}$ are short-circuited. Also in this case, a plurality of MOSFETs having the same W/L ratio may be arranged, or a plurality of MOSFETs having different W/L ratios may be arranged.

The first example of the temperature characteristic adjustment circuit has been described above. Subsequently, a second example of the temperature characteristic adjustment circuit will be described.

Figure 7:
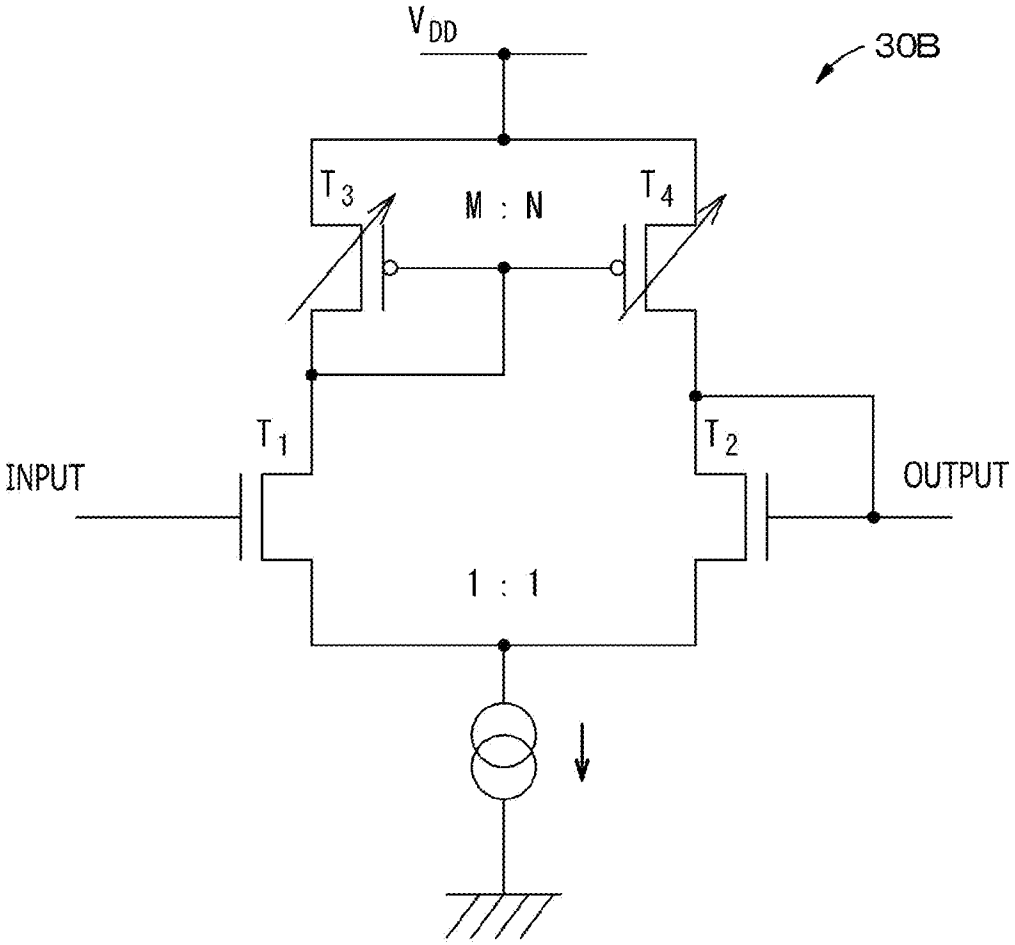
FIG. 7 is a schematic principle diagram of a second example of the temperature characteristic adjustment circuit.

FIG. 7 is a schematic principle diagram of a second example of the temperature characteristic adjustment circuit.

A temperature characteristic adjustment circuit 30B of the second example is configured so that the W/L ratios of the two paired MOSFETs ($T_1$, $T_2$) are the same (1:1), and the ratio of the flowing drain current is adjusted. The drain current ratio is adjusted by changing the mirror ratio (M:N) of the current mirror circuit having the transistors $T_3$ and $T_4$.

Figure 8:
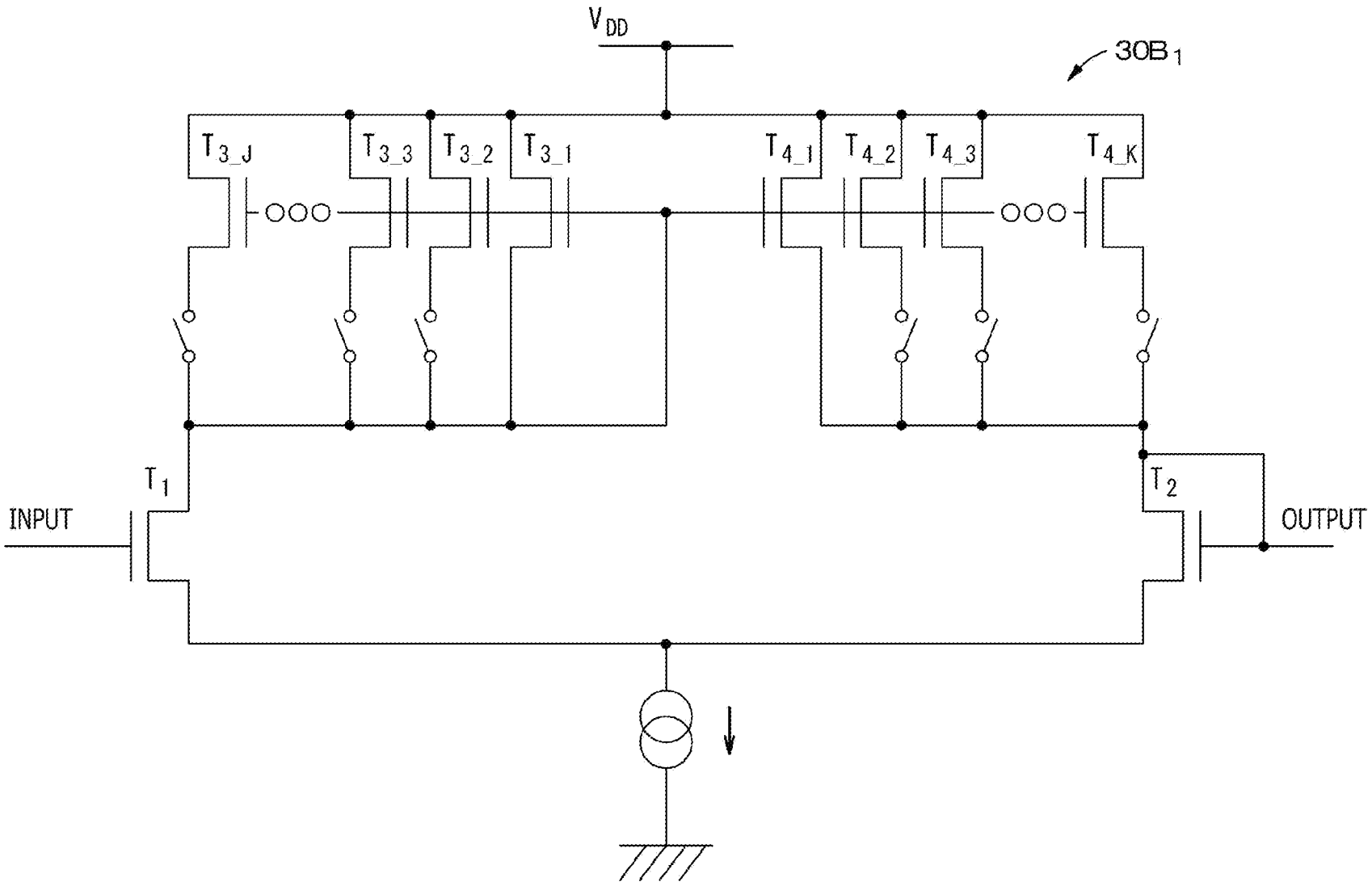
FIG. 8 is a configuration example of the second example of the temperature characteristic adjustment circuit.

FIG. 8 is a configuration example of the second example of the temperature characteristic adjustment circuit.

In a temperature characteristic adjustment circuit 30$B_1$, a plurality of MOSFETs (reference signs $T_{3_1}$ to $T_{3_J}$ and reference signs $T_{4_1}$ to $T_{4_K}$) that can be selected as MOSFETs that pass the mirror current are arranged in the current mirror circuit. The ratio of the drain currents flowing through the transistor $T_1$ and the transistor $T_2$ can be adjusted by appropriately selecting MOSFETs. Also in this case, a plurality of MOSFETs having the same W/L ratio may be arranged, or a plurality of MOSFETs having different W/L ratios may be arranged. The MOSFETs can be selected, for example, by trimming the semiconductor element on which the reference voltage circuit 1 is formed.

Although the embodiments of the present disclosure have been specifically described above, the present invention is not limited to the above-described embodiments of the present disclosure, and various modifications based on the technical idea of the present invention can be applied.

The reference voltage circuit of the present disclosure described above includes a PTAT voltage generation circuit that generates a voltage having a positive temperature coefficient, a CTAT voltage generation circuit that generates a voltage having a negative temperature coefficient, and a temperature characteristic adjustment circuit for generating a voltage for adjusting the temperature characteristics, and outputs a reference voltage formed by calculation from the output of the PTAT voltage generation circuit, the output of the CTAT voltage generation circuit, and the output of the temperature characteristic adjustment circuit. By using the temperature characteristic adjustment circuit, a wide adjustment range can be set, which can make fine adjustment.

It should be noted that the technology of the present disclosure can also have the following configurations.

[A1]

A reference voltage circuit including:

a PTAT voltage generation circuit that generates a voltage with a positive temperature coefficient;

a CTAT voltage generation circuit that generates a voltage with a negative temperature coefficient; and a temperature characteristic adjustment circuit that generates a voltage to adjust a temperature characteristic, in which the reference voltage circuit outputs a reference voltage formed by calculation from the output of the PTAT voltage generation circuit, the output of the CTAT voltage generation circuit, and the output of the temperature characteristic adjustment circuit.

[A2]

The reference voltage circuit described in the above item [A1] in which the temperature characteristic adjustment circuit is configured such that a voltage difference between an input side and an output side of the temperature characteristic adjustment circuit is a gate voltage difference between paired MOSFETs, and a current density ratio of drain currents in one MOSFET arranged on the input side and the other MOSFET arranged on the output side is adjustable.

[A3]

The reference voltage circuit described in the above item [A2], in which a plurality of MOSFETs capable of being selected as the one MOSFET or a plurality of MOSFETs capable of being selected as the other MOSFET, or a plurality of MOSFETs capable of being selected as the one MOSFET and a plurality of MOSFETs capable of being selected as the other MOSFET are arranged.

[A4]

The reference voltage circuit described in the above item [A3], in which the plurality of MOSFETs is arranged in parallel.

[A5]

The reference voltage circuit described in the above item [A4], in which the plurality of MOSFETs with the same W/L ratio is arranged.

[A6]

The reference voltage circuit described in the above item [A5], in which the plurality of MOSFETs with different W/L ratios is arranged.

[A7]

The reference voltage circuit described in the above item [A4], in which the plurality of MOSFETs is arranged in series.

[A8]

The reference voltage circuit described in the above item [A7], in which the plurality of MOSFETs with the same W/L ratio is arranged.

[A9]

The reference voltage circuit described in the above item [A7], in which the plurality of MOSFETs with different W/L ratios is arranged.

[A10]

The reference voltage circuit described in the above items [A2] to [A9], in which the plurality of MOSFETs of the temperature characteristic adjustment circuit operates in a subthreshold region.

[A11]

The reference voltage circuit described in the above item [A2], in which the temperature characteristic adjustment circuit includes a current mirror circuit for passing a drain current through each of the paired MOSFETs, and the current mirror circuit is configured so that the mirror ratio capable of being adjusted.

[A12]

The reference voltage circuit described in the above item [A11], in which a plurality of MOSFETs capable of being selected as a MOSFET that passes a mirror current is arranged in the current mirror circuit.

[A13]

The reference voltage circuit described in any one of the above items [A1] to [A12], in which the PTAT voltage generation circuit is configured by connecting structures each for extracting the gate voltage difference between two paired MOSFETs in multiple stages.

[A14]

The reference voltage circuit described in the above item [A13], in which the two paired MOSFETs of the PTAT voltage generation circuit operate in a subthreshold region.

[A15]

The reference voltage circuit described in any one of the above items [A1] to [A14], in which the CTAT voltage generation circuit is configured to output a base-emitter voltage of a bipolar transistor.

[B1]

An electronic apparatus including:

a reference voltage circuit including a PTAT voltage generation circuit that generates a voltage with a positive temperature coefficient, a CTAT voltage generation circuit that generates a voltage with a negative temperature coefficient, and a temperature characteristic adjustment circuit that generates a voltage to adjust a temperature characteristic, in which the reference voltage circuit outputs a reference voltage formed by calculation from an output of the PTAT voltage generation circuit, an output of the CTAT voltage generation circuit, and the output of an temperature characteristic adjustment circuit.

[B2]

The electronic apparatus described in the above item [B1], in which the temperature characteristic adjustment circuit is configured such that a voltage difference between an input side and an output side of the temperature characteristic adjustment circuit is a gate voltage difference between paired MOSFETs, and a current density ratio of drain currents in one MOSFET arranged on the input side and the other MOSFET arranged on the output side is adjustable.

[B3]

The electronic apparatus described in the above item [B2], in which a plurality of MOSFETs capable of being selected as the one MOSFET or a plurality of MOSFETs capable of being selected as the other MOSFET, or a plurality of MOSFETs capable of being selected as the one MOSFET and a plurality of MOSFETs capable of being selected as the other MOSFET are arranged.

[B4]

The electronic apparatus described in the above item [B3], in which the plurality of MOSFETs is arranged in parallel.

[B5]

The electronic apparatus described in the above item [B4], in which the plurality of MOSFETs with the same W/L ratio is arranged.

[B6]

The electronic apparatus described in the above item [B5], in which the plurality of MOSFETs with different W/L ratios is arranged.

[B7]

The electronic apparatus described in the above item [B4], in which the plurality of MOSFETs is arranged in series.

[B8]

The electronic apparatus described in the above item [B7], in which the plurality of MOSFETs with the same W/L ratio is arranged.

[B9]

The electronic apparatus described in the above item [B7], in which the plurality of MOSFETs with different W/L ratios is arranged.

[B10]

The electronic apparatus described in the above items [B2] to [B9], in which the plurality of MOSFETs of the temperature characteristic adjustment circuit operates in a subthreshold region.

[B11]

The electronic apparatus described in the above item [B2], in which the temperature characteristic adjustment circuit includes a current mirror circuit for passing a drain current through each of the paired MOSFETs, and the current mirror circuit is configured so that the mirror ratio capable of being adjusted.

[B12]

The electronic apparatus described in the above item [B11], in which a plurality of MOSFETs capable of being selected as a MOSFET that passes a mirror current is arranged in the current mirror circuit.

[B13]

The electronic apparatus described in any one of the above items [B1] to [B12], in which the PTAT voltage generation circuit is configured by connecting structures each for extracting the gate voltage difference between two paired MOSFETs in multiple stages.

[B14]

The electronic apparatus described in the above item [B13], in which the two paired MOSFETs of the PTAT voltage generation circuit operate in a subthreshold region.

[B15]

The electronic apparatus described in any one of the above items [B1] to [B14], in which the CTAT voltage generation circuit is configured to output a base-emitter voltage of a bipolar transistor.

REFERENCE SIGNS LIST

1, 1A, 9, 9A . . . Reference voltage circuit, 10 . . . CTAT voltage generation circuit, 20 . . . PTAT voltage generation circuit, 30, 30A, 30$A_1$, 30$A_2$, 30B, 30$B_1$ . . . Temperature characteristic adjustment circuit, Q . . . PNP bipolar transistor, $M_1$ to $M_{10}$, $M_1$ to $M_{2_J}$ . . . MOSFET group constituting PTAT voltage generation circuit, $M_P$ . . . MOSFET that carries mirror current, $M_N$ . . . MOSFET that acts as load resistor, $T_1$, $T_{1_1}$ to $T_{1_J}$ . . . One MOSFET located on input side of temperature characteristic adjustment circuit, $T_2$, $T_{2_i}$ to $T_{2_K}$ . . . Other MOSFET located on output side of temperature characteristic adjustment circuit, $T_3$, $T_{3_1}$ to $T_{3_J}$, $T_4$, $T_{4_1}$ to $T_{4_K}$ . . . MOSFETs that constitute current mirror circuit of temperature characteristic adjustment circuit

The invention claimed is:

1. A reference voltage circuit comprising:

a Proportional To Absolute Temperature (PTAT) voltage generation circuit that generates a voltage with a positive temperature coefficient;

a Complementary To Absolute Temperature (CTAT) voltage generation circuit that generates a voltage with a negative temperature coefficient; and a temperature characteristic adjustment circuit that generates a voltage to adjust a temperature characteristic, wherein the reference voltage circuit outputs a reference voltage formed by calculation from an output of the PTAT voltage generation circuit, an output of the CTAT voltage generation circuit, and an output of the temperature characteristic adjustment circuit.

2. The reference voltage circuit according to claim 1, wherein the temperature characteristic adjustment circuit is configured such that a voltage difference between an input side and an output side of the temperature characteristic adjustment circuit is a gate voltage difference between paired MOSFETs, and a current density ratio of drain currents in one MOSFET arranged on the input side and an other MOSFET arranged on the output side is adjustable.

3. The reference voltage circuit according to claim 2, wherein a plurality of MOSFETs selectable as the one MOSFET or a plurality of MOSFETs selectable as the other MOSFET, or a plurality of MOSFETs selectable as the one MOSFET and a plurality of MOSFETs selectable as the other MOSFET are arranged.

4. The reference voltage circuit according to claim 3, wherein the plurality of MOSFETs are arranged in parallel.

5. The reference voltage circuit according to claim 4, wherein the plurality of MOSFETs have a same W/L ratio.

6. The reference voltage circuit according to claim 4, wherein the plurality of MOSFETs have different W/L ratios.

7. The reference voltage circuit according to claim 3, wherein the plurality of MOSFETs are arranged in series.

8. The reference voltage circuit according to claim 7, wherein the plurality of MOSFETs have a same W/L ratio.

9. The reference voltage circuit according to claim 7, wherein the plurality of MOSFETs have different W/L ratios.

10. The reference voltage circuit according to claim 3, wherein the plurality of MOSFETs of the temperature characteristic adjustment circuit operates in a subthreshold region.

11. The reference voltage circuit according to claim 2, wherein the temperature characteristic adjustment circuit includes a current mirror circuit for passing a drain current through each of the paired MOSFETs, and the current mirror circuit is configured such that a mirror ratio adjustable.

12. The reference voltage circuit according to claim 11, wherein a plurality of MOSFETs capable of being selected as a MOSFET that passes a mirror current are arranged in the current mirror circuit.

13. The reference voltage circuit according to claim 1, wherein the PTAT voltage generation circuit is configured by connecting structures each for extracting a gate voltage difference between two paired MOSFETs in multiple stages.

14. The reference voltage circuit according to claim 13, wherein the two paired MOSFETs of the PTAT voltage generation circuit operate in a subthreshold region.

15. The reference voltage circuit according to claim 1, wherein the CTAT voltage generation circuit is configured to output a base-emitter voltage of a bipolar transistor.

16. An electronic apparatus comprising:

a reference voltage circuit including a Proportional To Absolute Temperature (PTAT) voltage generation circuit that generates a voltage with a positive temperature coefficient, a Complementary To Absolute Temperature (CTAT) voltage generation circuit that generates a voltage with a negative temperature coefficient, and a temperature characteristic adjustment circuit that generates a voltage to adjust a temperature characteristic, wherein the reference voltage circuit outputs a reference voltage formed by calculation from an output of the PTAT voltage generation circuit, an output of the CTAT voltage generation circuit, and an output of the temperature characteristic adjustment circuit.

17. The electronic apparatus according to claim 16, wherein the temperature characteristic adjustment circuit is configured such that a voltage difference between an input side and an output side of the temperature characteristic adjustment circuit is a gate voltage difference between paired MOSFETs, and a current density ratio of drain currents in one MOSFET arranged on the input side and an other MOSFET arranged on the output side is adjustable.

18. The electronic apparatus according to claim 17, wherein a plurality of MOSFETs selectable as the one MOSFET or a plurality of MOSFETs selectable as the other MOSFET, or a plurality of MOSFETs selectable as the one MOSFET and a plurality of MOSFETs selectable as the other MOSFET are arranged.

19. The electronic apparatus according to claim 18, wherein the plurality of MOSFETs are arranged in parallel.

20. The electronic apparatus according to claim 19, wherein the plurality of MOSFETs have a same W/L ratio.

* * * * *